United States Patent [19]

Chanin et al.

[11] 4,300,360

[45] Nov. 17, 1981

[54] SMALL-SIZE HERMETIC HELIUM 3 REFRIGERATION STAGE

[75] Inventors: Gerald Chanin, Verrieres le Buisson; Jean-Pierre Torre, Herblay, both of France

[73] Assignee: Agence Nationale de Valorisation de la Recherche (ANVAR), Neuilly sur Seine, France

[21] Appl. No.: 122,030

[22] Filed: Feb. 19, 1980

[30] Foreign Application Priority Data

Feb. 23, 1979 [FR] France ..... 79 04737

[51] Int. Cl.[3] ..... F25B 19/00

[52] U.S. Cl. ..... 62/514 R; 62/48

[58] Field of Search ..... 62/514 R, 56, 48

[56] References Cited

U.S. PATENT DOCUMENTS

| | | | |
|---|---|---|---|
| 3,397,549 | 8/1968 | Daunt | 62/56 |
| 4,111,002 | 9/1978 | Van Mal et al. | 62/514 R |
| 4,136,526 | 1/1979 | Chanin et al. | 62/514 R |

OTHER PUBLICATIONS

Yamamoto, J: "A He[3] Cryostat Using Charcoal Adsorption Pump for a Far Infrared Detector," *Japanese Jour. of App. Physics* vol. 14 No. 11, Nov. 1975.

Walton, D. et al., "A Compact [3]He Cryostat Using Activated Charcoal", *The Review of Scientific Instruments,* vol. 42 (1971) pp. 1265–1266.

Tanner, D. B., "Fluctuation Contrabution to the Far-Infrared Transmission of Lead Films," *Physical Review B,* vol. 8 No. 11 (1973).

Mate, C. F.: "[3]He Cryostat with Adsorption Pumping," The Review of Scientific Instruments, vol. 36 (1965) pp. 369–373.

*Primary Examiner*—Ronald C. Capossela

*Attorney, Agent, or Firm*—Peter K. Kontler

[57] ABSTRACT

The invention provides a small-size hermetic refrigeration stage containing helium 3 and easily incorporated in a conventional helium 4 metal cryostat.

The stage consists essentially of a metallic enclosure containing a certain volume of helium 3 and having a first receptacle constituting the pumping chamber and consisting a mass of an adsorbing body for the helium 3 at a very low temperature, a second receptacle constituting a condenser for the cooled helium 3 and a duct.

The stage of the invention is particularly suited for maintaining the sensitive element of an infrared detector at a temperature of less than 1° K.

11 Claims, 1 Drawing Figure

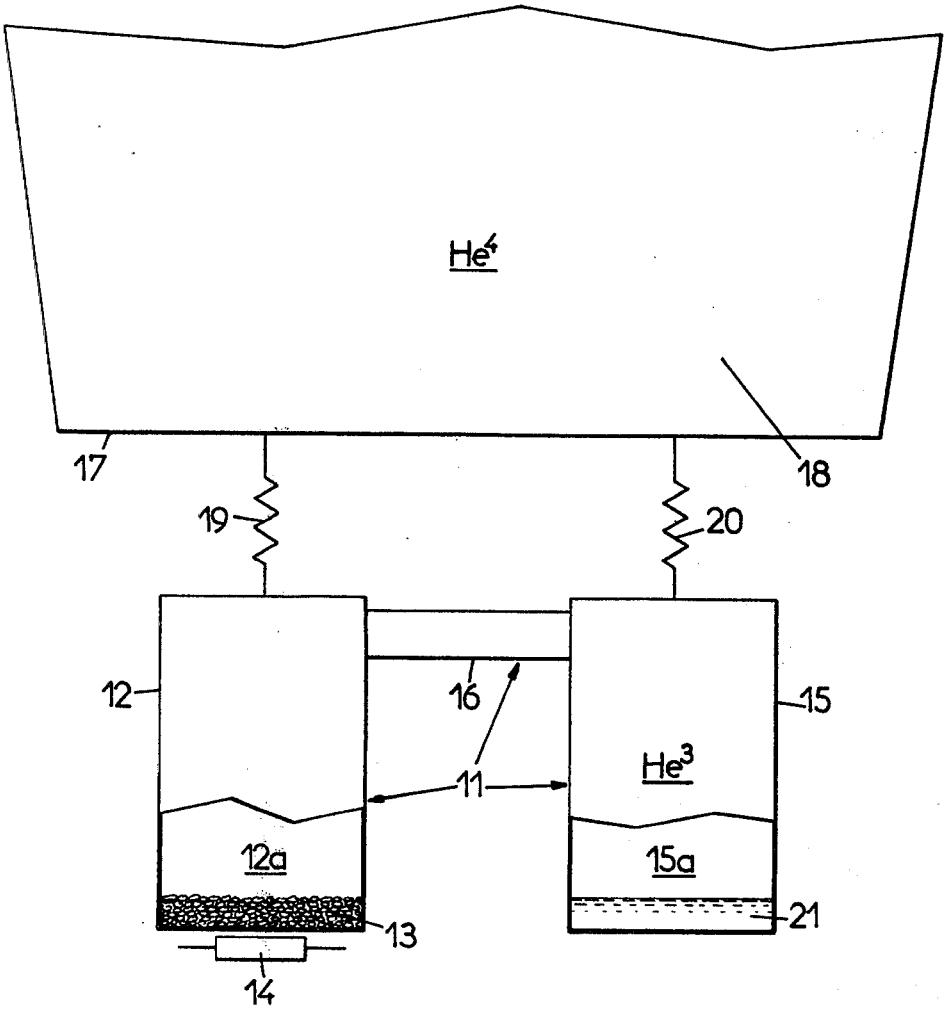
He4
17
18
19
20
12
16
15
He3
11
12a
15a
13
21
14

SMALL-SIZE HERMETIC HELIUM 3 REFRIGERATION STAGE

BACKGROUND OF THE INVENTION

The present invention relates to refrigeration at very low temperatures, less than 1° K.

It relates more particularly to a novel industrial product which is a small-size helium 3 hermetic refrigeration stage, of a reduced cost and static in character, i.e., comprising no moving parts (except possibly one or two heat switches) and being adapted to be readily incorporated in most conventional helium 4 metal cryostats, thus extending their field of use to about 0.3° K.

The stage of the invention is suitable for example for maintaining at a cryogenic temperature, less than 1° K., the sensitive element of an infrared region detector, particularly for experiments in the far infrared.

Our U.S. Pat. No. 4,136,526 discloses a portable helium 3 cryostat, comprising, disposed inside a portable helium 4 cryostat of a known type, a unit having an evaporation chamber containing in operation liquid helium 3, a reservoir at a level above the chamber, a first duct connecting the reservoir and the evaporation chamber, an adsorption chamber containing an adsorbent which absorbs helium 3 only below a critical temperature higher than that for vapporizing helium 4, and a second duct which connects the adsorption chamber to the first duct, a valve being disposed in the second duct, or at the inlet or outlet thereof, so as to be able to seal the adsorption chamber from the sub-unit including the reservoir, the evaporation chamber and the first duct, said unit, hermetically sealed, containing a gaseous mass of helium 3 which is highly compressed at ambient temperature.

This cryostat which performs very well and is easy to use exhibits however for some applications the disadvantage of a relatively high cost and requires the use of a helium 4 cooling apparatus with a removable bottom for receiving the helium 3 cryostat having the improvements in accordance with our patent.

Helium 3 cryostats are moreover known for use with detectors in the far infrared region making use of pumping by means of active charcoal. A cryostat of such type is described for example in an article by Junya Yamamoto published in the "Japanese Journal of Applied Physics," vol. 14, No. 11 (November 1975), pages 1807 to 1810, entitled "A $He^3$ Cryostat Using a Charcoal Adsorption Pump for a Far-Infrared Detector."

This cryostat comprises, in a vertical metal tube, an $He^3$ bath in its lower part, a condenser in its middle part and a mass of active charcoal in its upper part with a heating coil surrounding said mass. The unit is placed into an $He^4$ cooler.

For desorbing the $He^3$ gas out of said mass, the tube is evacuated, which requires a pump, and the mass of active charcoal is heated; on the other hand, adsorption is carried out by stopping the heating and the $He^3$ condenses on the walls (cooled by the $He^4$) of the middle part of the tube and falls to the bottom thereof while replenishing the $He^3$ bath in the lower part of the tube. It has been found that gravity plays a role, which prevents the cryostat according to this Japanese article from being operated in a position other than a substantially vertical position with the active charcoal in the upper part. Furthermore, this cryostat is immersed in a bath of liquid $He^4$ (which is pumped); therefore, it must be introduced into an $He^4$ cooler which must be constructed to allow such introduction.

A cryostat similar to the one of YAMAMOTO is described in an article by WALTON, TIMUSK and SIEVERS entitled "A compact $He^3$ cryostat using activated charcoal" in The Review of Scientific Instruments, volume 42 (1971) pages 1265–66.

Another cryostat substantially of the same type and having the same requirements of orientation and immersion in an $He^4$ cooler is described in an article by D.B. Tanner published in the Physical Review B, vol. 8, No. 11 (1 December 1973), pages 5045 and following and entitled "Fluctuation Contribution to the Far-Infrared Transmission of Lead Films" (see in particular pages 5046 to 5048 insofar as the cryostat is concerned).

The present invention aims at providing a helium 3 cryostat not having this requirement. In fact, it does not necessarily have to be used in a certain orientation with respect to gravity and it need not be introduced into a helium 4 cooler.

SUMMARY OF THE INVENTION

A helium 3 cryostat in accordance with the invention comprises a fluid-tight metallic enclosure confining a helium 3 charge, under a pressure which corresponds to a high pressure at ambient temperature, said enclosure including two receptacles or chambers communicating with each other through a duct of very low heat conductivity, one of these two receptacles containing a mass of a body able to adsorb the whole of the helium 3 volume contained in the enclosure and heating means being provided for heating said mass to a temperature at which desorption of helium 3 is substantially complete. Each receptacle is in heat contact, at least for certain periods of time, with a wall of a helium 4 cooler.

Said body able to adsorb the helium 3 volume is preferably, in a manner known per se, active charcoal, but it may also consist of zeolites.

The above and other objects, features and advantages of the present invention will become apparent from the following description, given solely by way of non-limiting illustration, when taken in conjunction with the accompanying drawing.

BRIEF DESCRIPTION OF THE DRAWING

The single FIGURE shows schematically by way of example a helium 3 cryostat which embodies one form of the invention.

DESCRIPTION OF THE PREFERRED EMBODIMENTS

In accordance with the invention, desiring to construct a small-size helium 3 cryostat or refrigerator, the following or similar is the way to proceed.

The helium 3 cryostat properly speaking is formed by a sealed metallic enclosure 11 containing a certain volume of helium 3 and comprising:

- a first receptacle 12 which forms the pumping chamber and contains a mass 13 of a body capable of adsorbing at low temperature (that of liquid helium 4, whose boiling temperature at atmospheric pressure is 4.2° K.) gaseous helium 3 and desorbing it at a higher temperature (for example 15° to 20° K.); a heating device 14 (for example an electric heater) enables said mass 13 to be heated to the desorption temperature;
- a second receptacle or chamber 15 which forms the condenser for the cooled helium 3;

a duct or tube 16 connecting receptacles 12 and 15.

Receptacles 12 and 15, which must be made of material which is a good conductor of heat, such as for example electrolytic copper; duct 16, which must have a very low heat conductivity, may be made of an alloy such as stainless (nickel and chrome) steel, monel metal, iconel (nickel, chrome and iron alloy), or any other appropriate material.

Enclosure 11 including the receptacles 12 and 15 and tube 16 is originally filled with helium 3 whose pressure at ambient temperature is high, for example 100 bars at 300° K.

Mass 13 consists of active or activated charcoal or zeolites. Its volume must be sufficient to be able to adsorb, when it is cooled to the temperature of the helium 4, bath, the entire volume of helium 3 contained in enclosure 11.

Enclosure 11 is fixed mechanically against a wall 17 of a helium 4 refrigerator 18 of a known type, used with infrared detectors; by way of example, the helium 4 cryostat manufactured by the firm "Infrared Laboratory" (USA) may be mentioned. Wall 17 may be made of copper, brass, stainless steel, for example.

Each of receptacles 12, 15 is in thermal communication with wall 17 by means of an appropriate thermal conductor; because of the low thermal conductivity of duct 16, receptacles 12 and 15 may be at different temperatures.

Furthermore, the thermal conductivity of the 17–15 connection 20 must increase rapidly with the temperature, i.e. the receptacle 15 must be at least substantially thermally decoupled from wall 17 when such receptacle is at a very low temperature, for example 0.3° K. and pronouncedly thermally coupled to wall 17 when its temperature is close to that of wall 17, for example between 1.5° and 3° K. To this end, the connection 20 may be made of beryllium oxide, alumina, sapphire, quartz, a supraconductor at a high critical temperature, or any other appropriate material. A controlled heat switch may also be used so that pronounced thermal conductivity is established only when required.

The thermal conductivity of the 17–12 connection 19 is much less critical. However it is preferable for it to tend to diminish with the temperature of the receptacle 12, i.e. it is preferable to thermally decouple the receptacle 12 from wall 17 when heating, by means of heating device 14, the adsorbent mass 13 which it contains with a view to limiting the evaporation of the helium 4 bath; on the other hand, a sufficient thermal coupling must be ensured between wall 17 and receptacle 12 when the heating is switched off so as to discharge the adsorption heat towards the helium 4 bath when the helium 3 gas is adsorbed. To this end, the connection 19 may constitute an appropriate passive thermal conductor, or it may include a controlled heat switch so that pronounced thermal conductivity is established only when required.

The apparatus shown in the single figure operates as follows.

It is assumed that enclosure 11 is filled with helium 3 gas at the pressure indicated above (100 bars and 300° K.) and that it contains active charcoal mass 13 in receptacle 12. Heating means 14 are stopped. The helium 4 introduced into cooler 18 is pumped so as to maintain wall 17 at less than 3° K., which entails, through connections 19 and 20, a cooling of enclosure 11 and adsorption of the helium 3 by the mass 13 contained in receptacle 12 of enclosure 11. When a temperature of less than 3° K. exists in enclosure 11, heating means 14 is switched on to bring mass 13 to about 15° K., so as to cause practically all the helium 3 which it contains to be desorbed by said mass.

Because of the poor thermal conductivity of the material of the duct 16, the length and the small section thereof, the relatively high temperature of the compartment 12*a* defined by the receptacle 12 is not transmitted to compartment 15*a* defined by the receptacle 15. The compartment 15*a* is then maintained at a temperature of about 1.5° to 3° K. through the thermal connection 20 whose thermal conductivity is much greater than that of duct 16 at this temperature.

The helium 3 desorbed by mass 13 condenses then on the cold walls of receptacle 15 while forming a liquid bath 21. The latent condensation heat of the helium 3 is discharged through connection 20 towards wall 17 and so towards the mass of helium 4. In fact, the speed of condensation is governed mainly by the thermal conductivity of connection 20. When the condensation of the helium 3 is complete, indicated by a very small temperature difference between receptacle 15 and wall 17, the heating means 14 is switched off. Receptacle 12 and so the contents of the compartment 12*a* which it defines, as well as mass 13, cool down. The heat is discharged through connection 19 towards wall 17 and so the helium 4 bath. While cooling down, mass 13 adsorbs the helium 3 gas which is evaporated in chamber 15*a*, causing a reduction in the pressure and cooling of the liquid by evaporation. This process gradually speeds up because, the cooler the mass 13 becomes, the more able it is to adsorb helium 3. The cooling rate of receptacle 12 and so of mass 13 which it contains is governed by the thermal conductivity of connection 19. Receptacle 15, because of the choice of the thermal conductivity of connection 20, which increases rapidly with the temperature and because of the low thermal conductivity of duct 16, is more and more thermally decoupled from wall 17 and may, therefore, without excessive evaporation of liquid helium 3, reach very low temperatures, through reduction of the saturating vapor of helium 3 which it contains.

After complete evaporation of the helium 3 from the compartment 15*a*, a new cycle may begin by starting up the heating device 14 without any action on refrigerator 18. During that phase when the mass 13 adsorbs the helium 3 gas, the temperature of the helium 4 bath may be brought up to 4.2° K. (normal boiling temperature), thus avoiding during this phase the need to pump on helium 4 refrigerator 18 for mass 13 of adsorbent is also able to adsorb helium 3 at this temperature.

By way of example, with a prototype whose enclosure 11 has the dimensions 50×50×30 mm and contains one liter of helium 3 (under normal temperature and pressure conditions), a temperature of 0.360° K. was obtained (at the base of receptacle 15) for a cooling power of the order of 100 microwatts for more than two hours.

The compartment in chamber 15*a* may contain a sintered metal sponge for retaining the helium 3 in the liquid state if it is desired to be free of gravity effects and so to be able to operate in all possible orientations, which is important in space. In this case the mass 13 will be retained by a grid or similar means.

As indicated above the connection 20 may consist of beryllium oxide BeO, and the connection 19 may consist of a simple very fine copper wire.

Connections switchable between two positions may also be formed by a conductor (made of copper for example) and a heat switch formed for example by a mechanical contact actuated by an electromagnet (the apparatus is not sensitive to magnetic fields). The connections 19 and 20 are then established (through control means of a known type) only when the need is felt. The connection 20 is established at the higher temperatures of receptacle 15 (during condensation of the helium 3 therein) and the connection 19 is established when the heating of receptacle 12 is stopped.

Since the thermal conductivity of beryllium oxide increases very rapidly with the temperature in the range 0.3° to 50° K., such material is particularly suitable for the making of the connection 20 because it is a particularly good conductor at temperatures of the order of 3° K. and a much poorer conductor at lower temperatures close to 0.3° K.

The advantages of the novel stage are as follows:

- very low cost, for it comprises no moving parts (except the mobile element of the switch(es) for connections 19 and 20 if such is the case), nor any valve; furthermore it comprises no precision finished parts because it merely includes receptacles and metal tubes (made of electrolytic copper and stainless steel respectively, for example); finally, it contains a very small mass of helium 3 (a gas which at the present time is very expensive: the cost being approximately 1000 French Francs per liter), which is not transformed by leakage or damage into a financial catastrophy;
- very small space required and great strength;
- conventional $He^4$ cryostats with access to the isolation vacuum chamber may be easily transformed into a cryostat in accordance with the invention for reaching about 0.3° K.; all that is required is the mechanical fixing of the enclosure 11 with the two thermal connections 19 and 20;
- it comprises no magnetic parts (except in a heat switch, if such be the case) and it may then be placed into a magnetic field;
- its operation does not depend on the relative position of the two receptacles in the enclosure 11; in particular, receptacle 15 may be located at a level above or at the level of the receptacle 12; the only restriction is that the outlet of the tube 16 at the receptacle 15 should be situated in its upper part; even this reservation may be disregarded if the interior of the receptacle 15 contains a device which is capable of trapping or retaining the helium 3 liquid phase by surface tension, electric or magnetic susceptibility (for example by using a very fine metal sponge of for example sintered metal) and if the mass 13 of adsorbent material is held in place by a metal grid or any other appropriate device; in this case, use in space in conditions of weightlessness (in a satellite or a rocket) is possible.

The following differences will be noted between the cryostats of the articles of YAMAMOTO and WALTON et al mentioned in the preamble of the present application, on the one hand, and the cryostat in accordance with the invention, on the other hand:

The refrigeration cycle in the cryostats described in the two articles differs considerably from the cycle of the invention at least during that portion of the cycle when the helium 3 gas is condensed to form the bath of liquid helium 3. In the devices according to the articles, a heat of "condenser" is used for removing the condensation from the helium 3 and for conducting it thermally to the helium 4 bath, through a direct and permanent contact between the wall and the liquid $He^4$. The liquid helium 3, which is formed at the level of this condenser, then flows by gravity into the evaporator. The drops of liquid helium 3 cool the evaporator down gradually by change of phase, while being vaporized on its walls.

In the refrigerator according to the present invention, the condenser is eliminated. The helium 3 condenses directly in receptacle 15, the condensation heat being transmitted to the walls of the $He^4$ chamber through a thermal contact established solely for this purpose, in accordance with the invention. Its presence and the absence of a condenser in permanent contact with the liquid $He^4$ form two major differences between the device of the invention and that described in the two above-mentioned articles.

The advantages of the novel stage in relation to those according to the two articles are as follows:

- doing away with the "condenser" in contact with the liquid $He^4$ allows this device to be used for transforming conventional cryostats having access to the isolation vacuum (as for example for those used in infrared detection experiments);
- the condensation of helium 3 directly in the evaporation chamber affords great freedom in the selection of relative positions of the two chambers and renders it possible to use the enclosure 11 in any orientation, even for operation in a state of weightlessness in a satellite or a rocket, which is not possible for the cryostats in accordance with the two above-mentioned articles.

U.S. Pat. No. 3,397,549, granted August 20, 1968 to DAUNT describes a "Cyclic desorption refrigerator" and develops prior work by MATE, LOWE, DAVIS and DAUNT published in The Review of Scientific Instruments, volume 36 (1965) pages 369–373.

The refrigeration cycle described in the patent to DAUNT is based on thermodynamic principles fundamentally different from those used in the stage of the invention. The low temperature of this stage is obtained by virtue of the cooling effect due to the vaporization heat of the bath of liquid helium 3, whereas the DAUNT patent makes use of the cooling effect by the desorption heat of a gas, freed by an adsorbent. Although an adsorbent is used in the cryostat of the invention, the cooling effect has nothing to do with the desorption of the helium 3 gas by the adsorbent. On the contrary, the desorption heat is compensated for by the heating device of the chamber containing the adsorbent. In the device described in the DAUNT patent, at no time during the refrigeration cycle is there condensation in liquid form of the gas used. It is even impossible according to the principle of operation.

A second fundamental difference is that in the stage of the invention, the system is hermetically closed and forms a unit requiring neither valves, nor pumps, nor compressors, nor external sources for the gas used. On the other hand, U.S. Pat. No. 3,397,549 relates to a system in which the gas used comes from outside the cryostat and requires, for its use, external valves, pumps and compressors, as well as a reservoir for recovery of the gas.

It is apparent that within the scope of the invention, modifications and different arrangements can be made other than are here disclosed. The present disclosure is merely illustrative with the invention encompassing all variations thereof.

We claim:

1. A helium 3 cyrostat, comprising a fluid-tight metallic enclosure containing a charge of helium 3, at a pressure which is high at the ambient temperature, said enclosure including two receptacles and a duct of very low thermal conductivity communicatively connecting said receptacles to each other; a mass of a body able to adsorb the entire volume of helium 3 contained in the enclosure, said mass being provided in one of said receptacles; means for heating said mass to a temperature at which the desorption of helium 3 in said one receptacle is substantially complete with attendant condensation of helium 3 in the other of said receptacles; a helium 4 cooler having a wall; and means for intermittently establishing thermal contact between said receptacles and said wall.

2. The helium 3 cryostat as claimed in claim 1, wherein said body consists of active charcoal.

3. The helium 3 cryostat as claimed in claim 1, wherein said receptacles consist of electrolytic copper.

4. The helium 3 cryostat as claimed in claim 1, wherein said duct consists of a metallic material selected from the group consisting of iron, chrome and nickel alloys and stainless steel.

5. The helium 3 cryostat as claimed in claim 1, wherein said means for establishing thermal contact between the other of said receptacles and said cooler is a substance whose thermal conductivity increases rapidly at temperatures between 0.3° K. and the temperature of said cooler.

6. The helium 3 cryostat as claimed in claim 5, wherein said substance is beryllium oxide.

7. The helium 3 cryostat as claimed in claim 1, wherein said means for establishing thermal contact between said cooler and said one receptacle is a copper wire.

8. The helium 3 cryostat as claimed in claim 1, wherein said means for establishing thermal contact between said cooler and at least one of said receptacles comprises a controlled heat switch.

9. The helium 3 cryostat as claimed in claim 1, further comprising means for retaining said mass in position in said one receptacle.

10. The helium 3 cryostat as claimed in claim 1, further comprising means for retaining the liquid helium 3 in the other of said receptacles.

11. The helium 3 cryostat as claimed in claim 10, wherein said retaining means comprises a metal sponge.

* * * * *